United States Patent [19]

Mertens

[11] Patent Number: 4,625,760

[45] Date of Patent: Dec. 2, 1986

[54] MOBILE CONCRETE HANDLING APPARATUS

[75] Inventor: Heinz Mertens, Hamm, Fed. Rep. of Germany

[73] Assignee: Walter Scheele GmbH & Co. KG, Unna-Massen, Fed. Rep. of Germany

[21] Appl. No.: 711,974

[22] Filed: Mar. 14, 1985

[30] Foreign Application Priority Data

Mar. 15, 1984 [DE] Fed. Rep. of Germany ..... 3409474

[51] Int. Cl.[4] ..... F16L 37/28; F16L 25/00

[52] U.S. Cl. ..... 137/615; 285/283; 285/62

[58] Field of Search ..... 137/615; 285/62, 283

[56] References Cited

U.S. PATENT DOCUMENTS

| | | | |
|---|---|---|---|
| 96,982 | 11/1869 | Couhling | 285/283 |
| 109,332 | 11/1870 | McGowan | 285/283 |
| 691,858 | 1/1902 | Hart | 285/283 |
| 3,221,771 | 12/1965 | Dollinger | 137/615 |
| 3,459,222 | 8/1969 | McElroy | 137/615 |
| 3,572,380 | 3/1971 | Jackson et al. | 137/615 |
| 3,685,543 | 8/1972 | Schwing et al. | 137/615 |
| 3,707,990 | 1/1973 | Schaible et al. | 137/615 |
| 3,964,512 | 6/1976 | Dumas | 137/615 |

FOREIGN PATENT DOCUMENTS

| | | |
|---|---|---|
| 1800046 | 9/1968 | Fed. Rep. of Germany . |
| 1949826 | 4/1971 | Fed. Rep. of Germany . |
| 1759404 | 9/1971 | Fed. Rep. of Germany . |
| 3207443 | 9/1983 | Fed. Rep. of Germany . |

*Primary Examiner*—A. Michael Chambers

*Attorney, Agent, or Firm*—Karl F. Ross; Herbert Dubno

[57] ABSTRACT

The disclosure relates to mobile concrete delivery devices and similar heavy equipment, which includes a plurality of carrier arms which can be moved or swung with respect to one another. Along the carrier arms are provided conduits or pipes of a concrete distributing apparatus. At the terminal carrier arm an output unit is arranged which is comprised of an additional carrier arm and an additional concrete conveying conduit. The output unit is connected in such a way that in its rest position it extends parallel with respect to the terminal carrier arm. The output unit is adapted to adjust itself when it assumes the operating position to assume a tight coupling position with respect to the terminal carrier arm and the associated concrete conduit. The apparatus makes it feasible to enhance the longitudinal reach of the concrete delivery apparatus by the length of the additional carrier arm without requiring substantial additional efforts for the installation thereof.

11 Claims, 5 Drawing Figures

MOBILE CONCRETE HANDLING APPARATUS

FIELD OF THE INVENTION

This invention relates to a mobile concrete handling and delivering apparatus and, more particularly, to a truck-mounted concrete pumper of the snorkel or boom type.

BACKGROUND OF THE INVENTION

Truck-mounted apparatus or similar vehicles for the emplacement of concrete, for example a pumper for concrete mixed in transit, generally include a plurality of carrier arms which are hingedly joined and/or similarly connected, linked or coupled to one another. The arms can be moved or swung with respect to one another. Such apparatus, furthermore, can include a concrete pump and conduits extending along the arms to convey the concrete. The apparatus allows folding of the arms into a more compact or rolled-up condition as a rest position and unfolding into an operating condition or position.

The concrete distributing conduit system is additionally connected to a rotary turntable or tower. Apart from such vehicular concrete pumpers, such apparatus can be employed in combination with a tower crane to emplace concrete in the construction of high rise and similar tall structures. They are also used individually as so-called stationary concrete-distributing apparatus.

The primary use of such apparatus is for delivering concrete in flowable form within the effective reach thereof, i.e. the effective distance from the vehicle or tower to the location to which the concrete is pumped. Of course, the greater the reach of the apparatus, the more favorable is the operating range and the longer the vehicle can remain at one location before being relocated to serve other locations which could initially not be covered.

Accordingly, a foremost aim in the development of such apparatus has been the increase of the effective or operational reach, or longitudinal range thereof. However, there are limits due to bulk, weight and balance.

It has been suggested to extend the reach of the entire concrete distribution apparatus by bolting at the terminal carrier arm an additional boom or extension-arm piece or element, for example by screw threads. It is also known to furnish this extension arm as a telescopically extensible element.

A further proposal to extend the effective reach of apparatus for handling concrete in fluid form contemplates the provision of additional extension-arm piece or boom element which is swung to be laterally disposed along the terminal carrier arm in the rest condition and which is swung forwardly and secured by lock pins or similar means.

These prior art arrangements generally requires extra effort, either effort by operating personnel or extra technical effort to move the additional carrier arm from the corresponding rest position into the respective and proper operating position, and vice versa.

OBJECTS OF THE INVENTION

It is therefore an object of this invention to provide an apparatus for emplacing concrete in flowable form which obviates the disadvantages of prior art apparatus.

It is also an object of the invention to provide an apparatus for distributing concrete in which the effective reach or range is enhanced.

It is yet another object of the invention to provide an apparatus in which the effective reach can be extended without special adjustment devices or operations.

SUMMARY OF THE INVENTION

These objects are attained in accordance with the invention in that at the terminal carrier arm a folding frame forming an outlet or discharge unit is provided, the frame comprising an additional carrier arm and a further conveying conduit linked in a hinge-like manner, or in a similar way allowing swing movement of its elements. This output unit is adapted, on the one hand when the concrete distributor is in the contact or stored condition to be positioned parallel to the terminal carrier arm and generally horizontal.

The output unit is also adapted, when the concrete distributing apparatus is unfolded, to extend vertically downwardly. As well, for example when the terminal carrier arm extends vertically downwardly, the output unit can be locked to the terminal arm to provide a continuous and cooperating structure therewith to convey concrete. The additional carrier arm is then coaxial with respect to the terminal carrier arm, and the additional conveyer conduit piece is coaxially fixed with respect to the terminal concrete conveyer conduit section.

In accordance with a preferred embodiment, the concrete emplacing or distributing apparatus includes connecting means for coupling the terminal carrier arm and the additional carrier arm. The coupling means can be flanged elements or similar components which extend over one another and interfit. These means allow, in the rest condition and during the folding up, swinging movements of the output unit with respect to the terminal carrier arm via a common hinge or pivot point.

On the other hand, a rigid connection is achieved between the output unit and the terminal carrier arm, and a tight form-locking coupling of the additional conveying piece to the concrete conveying conduit is also attainable by the coupling means, especially when the hinge between the terminal arm and the additional arm is located on the leading side during the unfolding motion. The interfitting parts then are braced by gravitational action as the additional arm is swung through its vertical position. Conversely, when the terminal arm is swung in the opposite or folding direction, the gravitational action tends to fold the hinge which can be located in its extended position by a pin.

BRIEF DESCRIPTION OF THE DRAWING

The above and other objects, features and advantages will become apparent from the following description, reference being made to the accompanying drawing in which.

SPECIFIC DESCRIPTION

Figure 1:
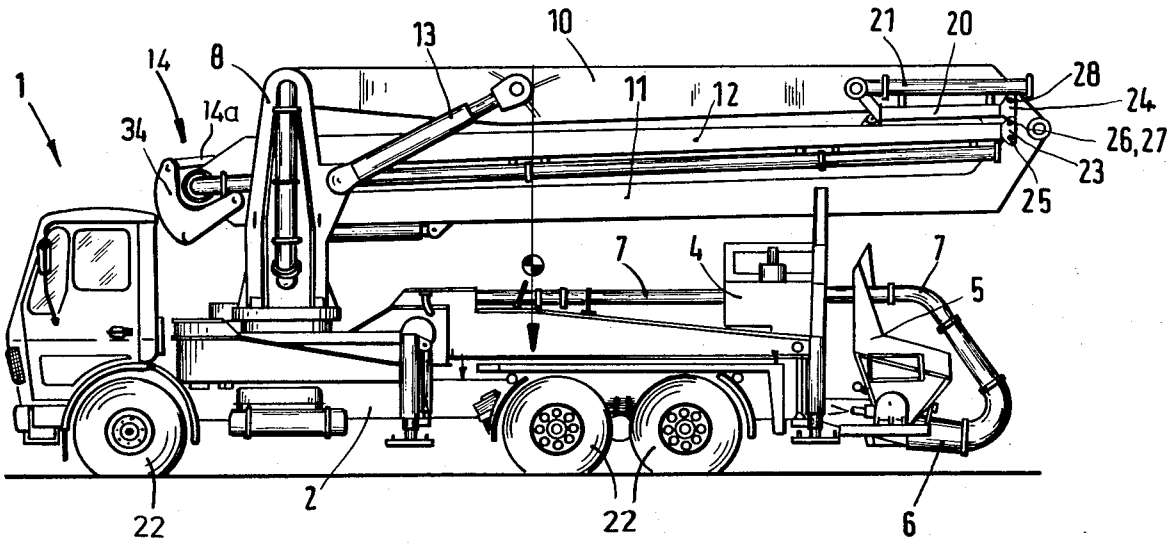
FIG. 1 is a side-elevational view of a truck for pumping concrete in accordance with the invention.

FIG. 1 shows a pumper for the pumping of concrete delivered in ready-mixed form from another supply to place the concrete in a construction site.

The vehicle shown in FIG. 1 includes a cab 1 which houses the engine or motor for the provision of motive power to the wheels 22 which are carrying the chassis or base frame 2 of the vehicle. The concrete is delivered to a hopper 50 which feeds a piston pump not shown, which is governed by a control unit 4 to displace the concrete through a duct 51. Outriggers 52 carry feet 53 to support the vehicle when the boom is unfolded and is swung well outwardly of the center of gravity G (see the commonly owned copending application filed concurrently herewith Ser. No. 710,857.

The piston pump operates in the manner of a tandem pump. Accordingly, the pump can carry out two strokes per cycle, namely a suction stroke and a pressure stroke. During the suction stroke concrete is drawn in from a receiving and/or feeding or delivery container 5 connected to the holder and is then forced during a subsequent pressure stroke into pressure conduit 6 and a plurality of conveying conduits 7 forming the duct 51.

The concrete conveyer conduit extends through a rotary tower structure 8. In general this concrete conduit is supported by several arms which are adjustable with respect to height and which belong to a distributor mast or similar tower. Thus, the concrete assembly serves to bring concrete to the desired location by the respective pumping action. Accordingly, in conformity with the tandem pump concept, respective columns of concrete are sequentially pressed out of one or the other cylinder.

Three adjustable carrier arms 10, 11 and 12 are interconnected by hinge joints. The lower, base or first carrier arm 10 is hingedly or pivotally linked to the tower structure 8 with its respective forward end 10*a*.

In this specification the term "forward" and similar references to location will means forward in the direction of travel, i.e. toward the cab, and "rearward" will mean, accordingly, the direction away from the cab in the direction opposite to the direction of travel.

The first carrier arm 10 can be swung or pivoted about the center or axis of rotation 10*b* by way of a piston-cylinder unit 13 comprised of a piston rod 13*a* and a cylinder 13*b*, in such a way that the arm 10 is swung in counterclockwise direction (arrow A in FIG. 2) when the piston-cylinder unit 13 carries out a lift stroke, i.e. when the piston rod 13*a* is extended or driven out. It will be appreciated that the free end of the piston rod 13*a* and/or the lower end of the cylinder 13*b* is pivotally joined to the first carrier arm 10 and at the tower structure 8 so that the first carrier arm 10 can carry out the corresponding clockwise and counterclockwise motions, for raising and lowering itself as well as the two associated carrier arms 11 and 12.

In the rest position indicated in FIG. 1, the first carrier arm 10 is generally positioned parallel to the chassis 2 of the vehicle. The intermediate carrier arm 11 and the third carrier arm 12 extend parallel to arm 10 in like manner. Thus, the three carrier arms 10, 11 and 12 are folded together in such a way that the third carrier arm 12 in the shown rest position in FIG. 1, is positioned between the first carrier arm 10 and the second or intermediate carrier arm 11. This condition is also referred to as the folded, compact or rolled-up position.

The intermediate carrier arm 11 and the first carrier arm 10 are connected to one another by way of a piston-cylinder unit 32, also comprised of a piston rod 32*a* and a cylinder 32*b*, and pivotally or hingedly mounted. The third or terminal carrier arm 12 is joined with its respective end to the intermediate or second carrier arm 11 and actuated by way of the piston-cylinder unit 14. When in the indicated rest position of FIG. 1, the end of the terminal carrier arm 12 is adjacent to the piston-cylinder unit 32 (omitted in FIG. 1) between the first carrier arm 10 and the second carrier arm 11.

The conduit sections 7 which are specifically intended for conveying concrete, are disposed in parallel manner to the carrier arms 10, 11 and 12 and respective sections are securely connected to each carrier arm.

The conduits 7 are connected at the respective hinge points by way of rotary couplings 33. One of these is most clearly shown in FIG. 2 at the interface location of the second carrier arm 11 and the third carrier arm 12. The couplings 33 allow the respective rotary or radial movements of the respective conduit sections in conjunction with the movements performed by the carrier arms as dictated by the operation of the apparatus.

A folding frame device or ouput unit 19 is connected to the free end of the third carrier arm 12. This unit includes an additional carrier arm 20 and an associated further conveying conduit piece 21.

The connection for the unit includes a pair of flanges which are connected in such a way that a flange element 23 is secured at the end of the third carrier arm 12, and a corresponding flange element 24 is provided at the additional carrier arm 20. The flange element 23 is furnished with two bores 25 and 26, and the flange element 24 is furnished with matching bores 27 and 28.

Figure 5:
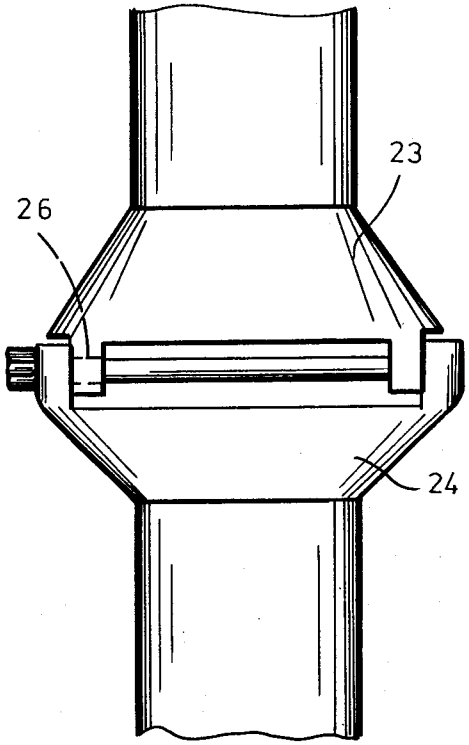
FIG. 5 is a side view of the joint in this latter position.
Figure 4:
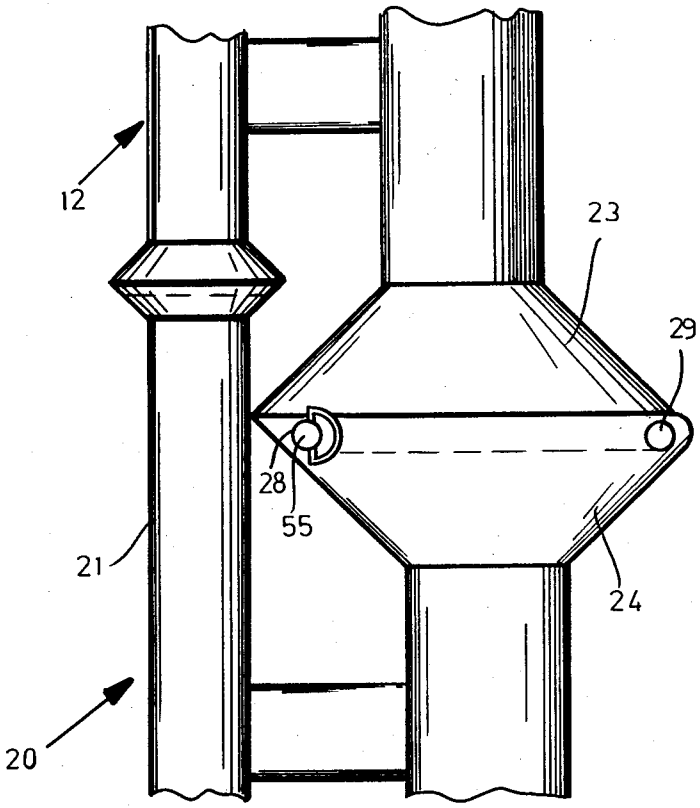
FIG. 4 is a view of this joint in its extended condition.

The flange elements 23 and 24 at least partially overlap or extend over one another and the pairs of bores (25, 26 and 27, 28) are aligned when the two flange pieces or elements 23 and 24 are cooperatingly and interfittingly connected, i.e. folded over each other (FIGS. 4 and 5). The basic position of the connection between the third carrier arm 12 and the additional carrier arm 20 is such that the flange elements 23 and 24 are hingedly or similarly movably joined to one another via a pair of bores, i.e. bore 26 of flange element 23 and bore 27 of flange element 24, also referred to as a pivot point (26, 27), and a respective pivot shaft 29 or the like member.

Accordingly, the output unit 19 comprised of the additional carrier arm 20 and the further piece of conveying conduit 21, is coupled to the arm 12. As is shown in FIG. 1, this output unit 19 rests or lies on the third carrier arm 12 and extends in the direction towards the tower structure 8.

Figure 2:
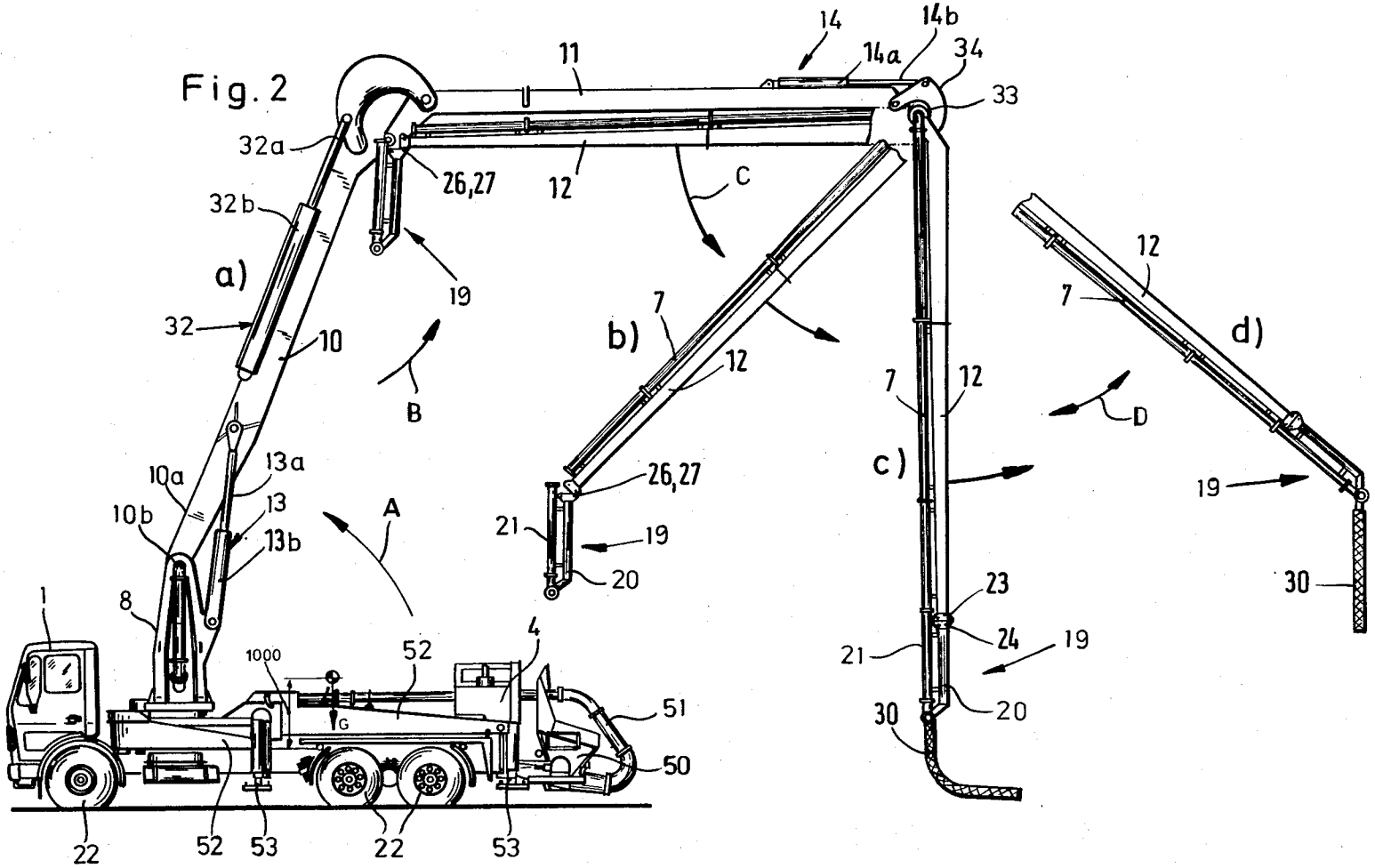
FIG. 2 is a side-elevational view showing in greater detail the movements carried out by the support arms and the associated conduits for fluid concrete.
Figure 3:
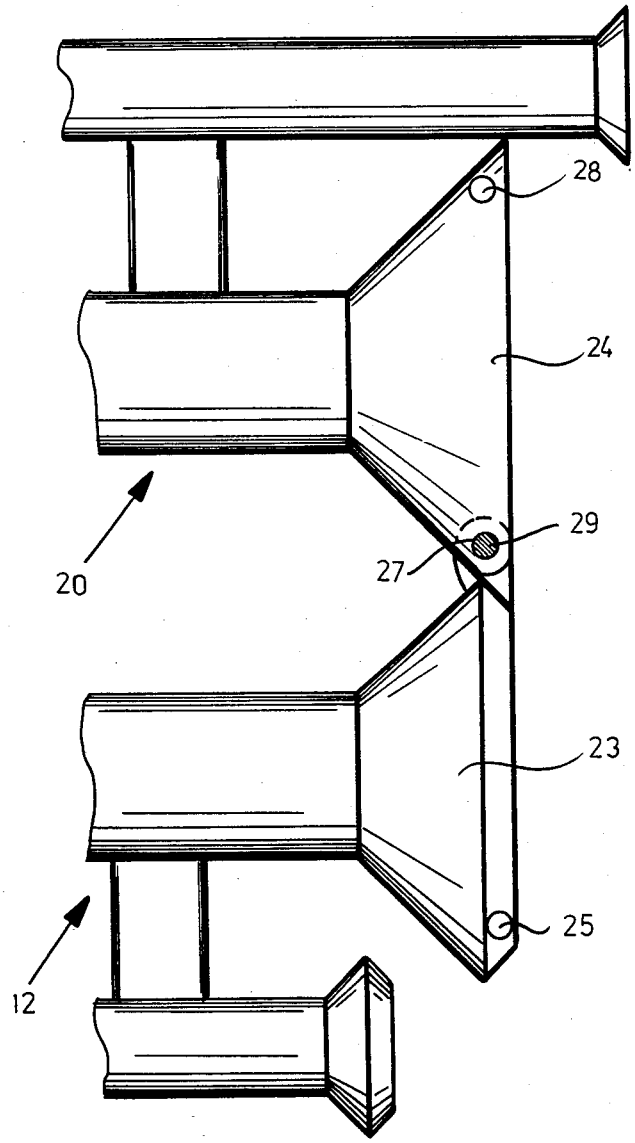
FIG. 3 is a detail view of the joint between the terminal arm and the additional arm.

It is also important in this invention that the carrier arm be able to pass through four phases of unfolding, from the rest or inoperative position, into the operative or extended position or condition. These positions are shown in FIG. 2.

In the first phase, the first carrier arm 10, which is pivotally linked to the tower structure 8, is raised by extending the piston rod 13*a* of the piston-assembly unit 13. This first carrier arm 10 is accordingly swung or pivoted in a counterclockwise direction, as is indicated by the arrow A in FIG. 2 into the position (a).

The intermediate or second carrier arm 11 and the terminal or third carrier arm 12, as well as the associated conduit sections 7 or the like elements, are carried along. The second carrier arm 11 and the third carrier arm 12 are next swung together in counterclockwise direction away from the first carrier arm 10 (see arrow B). During this movement, the output unit 19 gradually assumes the vertically downwardly pending attitude from its pivot center 26, 27 due to gravity.

Next, the previously horizontal third carrier arm 12 is lowered in counterclockwise direction (see arrow C) by actuation of the piston 14*a* (retraction) until it reaches the vertically downwardly directed attitude suggested in phase 2*c*. The output unit 19, however, remains in its vertically and downwardly directed pending state, which is fixed or determined by or with respect to the pivot point (26, 27).

When the aligned phase of (c) is attained, the longitudinal central axes of the third carrier arm 12 and of the additional arm 20 are in line. Accordingly, the carrier arm 20 provides an exactly aligned extension or continuum of the third carrier arm 12. In this position, the cooperatingly formed flange elements 23 and 24 are fully in their overlapping and form-locking position or condition. Now, a lock pin can be inserted into the aligned pair of bores, i.e. bore 25 of flange element 23, and bore 28 of flange element 24.

Accordingly, the output unit 19 is now fully flanged to the arm 12, and the carrier arm 12 is extended, as is the conduit section 7 associated with it which conduit section 7, in turn, is extended in length by the further conduit 21. This extension is accordingly achieved without undue consumption of energy, because the output unit 19, by way of its respective movement-kinematic, alone due to its mass attains the correct coupling position.

The concrete handling apparatus, i.e. the rigidly assembled and/or continuous concrete conduit can now start to feed concrete. To complete the apparatus, an end hose 30 is mounted at the lower end of the output device 19. This end hose 30 is preferably flexible and is connected by conduit 21 to section 7 to deposit the concrete.

The carrier arm 12 and the associated conduit section 7 can be freely moved by way of the piston-cylinder unit 14 in the directions of arrow D.

Folding of the apparatus into the rest position is achieved in the opposite sequence.

I claim:

1. A concrete distributing apparatus comprising:

a base;

a plurality of articulated support arms having respective duct sections in communication to deliver concrete to a location remote from said base upon unfolding of said support arms in an operating condition, said support arms including a terminal arm and being foldable to lie substantially parallel and horizontal in a rest condition;

an additional support arm articulated to said terminal arm and adapted to fold relative to said terminal arm to lie parallel therewith in said rest position but swingable away from said terminal arm into an operative position wherein said terminal arm and said additional arm are aligned when said terminal arm is disposed vertically, said additional arm being mounted to swing freely from a free end of said terminal arm but being provided with means for arresting said additional arm in alignment with said terminal arm, said additional arm hanging vertically when it is not folded relative to said terminal arm and is not arrested therewith; and an additional duct section carried by said additional arm and aligned and connected with a duct section on said terminal arm upon said additional arm being arrested in alignment with said terminal arm.

2. The apparatus defined in claim 1 wherein said terminal arm and said additional arm are formed with respective flanges hingedly connected at one side and abutting in an aligned position of said additional arm and said terminal arm to form a rigid junction therebetween.

3. The apparatus defined in claim 2 wherein said flanges have aligned holes in said aligned position traversed by a removable pin.

4. An apparatus for handling concrete, said apparatus comprising:

a base structure;

a first carrier arm having a first end pivotally secured to said base structure but allowing pivotal movement so as to move said first carrier arm from a horizontal rest position into a raised position corresponding to an operative condition of said apparatus, said first carrier arm having a second end remote from its first end;

a piston-cylinder unit connected between said base structure and said one first carrier arm for effecting pivotal movements of said first carrier arm with respect to said base structure;

an intermediate carrier arm having a first end pivotally secured to said first carrier arm at the second end thereof for entrainment with said first carrier arm during movement thereof but allowing pivotal movement of said intermediate carrier arm with respect to said first carrier arm at least when said first carrier arm is in its operative position, said intermediate carrier arm having a second end remote from its first end;

a piston-cylinder unit connected between said first carrier arm and said intermediate carrier arm for effecting pivotal movement of said intermediate carrier arm with respect to the second end of said first carrier arm;

a terminal carrier arm, said terminal carrier arm having a first end with which it is pivotally secured to said intermediate carrier arm at the second end thereof for being entrained with said intermediate carrier arm during movement of said intermediate arm but allowing pivotal movement of said terminal carrier arm with respect to said intermediate carrier arm at least when said first carrier arm is in its operative position;

a piston-cylinder unit connected between said intermediate carrier arm and said terminal carrier arm to effect pivotal movement of said terminal carrier arm relative to the second end of said intermediate carrier arm, said arms having interconnected conduit for flowable concrete;

an output unit operatively linked to said terminal carrier arm, said unit including:

an additional carrier arm, and a further conveying conduit secured to and positioned alongside said additional carrier arm, said output unit being capable of movement from a position in which it extends substantially parallel to said terminal carrier arm into a position in which it extends substantially vertically downwardly;

coupling means for connecting said output unit to said terminal carrier arm in hinge-like manner and for fixing said output unit in the vertically downwardly extending position whereby said additional carrier arm extends substantially coaxially with respect to said terminal carrier arm, and said further conveying conduit extends substantially coaxially with respect to the conduit of said terminal carrier arm, said coupling means including:

at least two flange-type coupling pieces for operatively linking said terminal carrier arm and said additional carrier arm to one another, with respective coupling pieces extending over one another but allowing swinging movements of said output unit with respect to said terminal carrier arm and allowing a substantially rigid connection of said output unit and said terminal carrier arm for a tight form-locking coupling of the respective conduit section of said at least one terminal carrier arm and said further concrete conveying conduit, at least when said apparatus is in its operative position.

5. The apparatus defined in claim 4 wherein the terminal carrier arm is connected to said intermediate carrier arm by a yoke member.

6. The apparatus defined in claim 4 wherein said coupling pieces are joined by means of a common linkage member.

7. The apparatus defined in claim 4, further comprising an end hose secured to said output unit at said further conveying conduit.

8. The apparatus defined in claim 4 wherein said base structure is mounted on a truck.

9. The apparatus defined in claim 4 wherein the conduit of said first intermediate and terminal arm comprises sections connected by rotary couplings.

10. The apparatus defined in claim 4 wherein said one first carrier arm, said intermediate carrier arm, said carrier arm and said output unit are folded in the rest position of said apparatus such that the terminal carrier arm is positioned between said intermediate carrier arm and said first carrier arm.

11. The apparatus defined in claim 10 wherein in the rest position of said apparatus said first carrier arm, said intermediate carrier arm, said terminal carrier arm and said output unit are positioned parallel with respect to one another.

* * * * *